US007545091B2

(12) United States Patent
Lee et al.

(10) Patent No.: US 7,545,091 B2
(45) Date of Patent: Jun. 9, 2009

(54) ELECTRON EMISSION DEVICE

(75) Inventors: Byong-Gon Lee, Suwon-si (KR); Sang-Jo Lee, Suwon-si (KR); Sang-Ho Jeon, Suwon-si (KR); Sang-Hyuck Ahn, Suwon-si (KR); Su-Bong Hong, Suwon-si (KR); Chun-Gyoo Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 537 days.

(21) Appl. No.: 11/283,794

(22) Filed: Nov. 22, 2005

(65) Prior Publication Data

US 2006/0113889 A1 Jun. 1, 2006

(30) Foreign Application Priority Data

Nov. 30, 2004 (KR) ..... 10-2004-0099266

(51) Int. Cl.
*H01J 1/62* (2006.01)

(52) U.S. Cl. ..... 313/495; 313/497; 313/308

(58) Field of Classification Search ..... None
See application file for complete search history.

(56) References Cited

U.S. PATENT DOCUMENTS 6,353,280 B1 * 3/2002 Shibata et al. ..... 313/292
2002/0074934 A1 * 6/2002 Beeteson et al. ..... 313/495

FOREIGN PATENT DOCUMENTS

| | | |
|---|---|---|
| JP | 04-366525 | 12/1992 |
| JP | 08-045448 | 2/1996 |
| JP | 2001-023506 | 1/2001 |
| JP | 2001-297690 | 10/2001 |
| JP | 2001-312958 | 11/2001 |
| JP | 2002-075166 | 3/2002 |
| JP | 2003-151456 | 5/2003 |
| JP | 2003-217468 | 7/2003 |
| JP | 2004-031329 | 1/2004 |

* cited by examiner

*Primary Examiner*—Ashok Patel
(74) *Attorney, Agent, or Firm*—Robert E. Bushnell, Esq.

(57) ABSTRACT

An electron emission device includes first electrodes arranged on a substrate in a direction of the substrate, and an insulating layer arranged on an entire surface of the substrate and covering the first electrodes. Second electrodes are arranged on the insulating layer and are perpendicular to the first electrodes. Electron emission regions are connected to one of the first and the second electrodes. The lateral edges of the first electrodes and the lateral edges of the second electrodes respectively cross each other.

14 Claims, 10 Drawing Sheets

ELECTRON EMISSION DEVICE

CLAIM OF PRIORITY

This application makes reference to, incorporates the same herein, and claims all benefits accruing under 35 U.S.C. § 119 from an application for ELECTRON EMISSION DEVICE earlier filed in the Korean Intellectual Property Office on the 30 of Nov. 2004 and there, duly assigned Serial No. 10-2004-0099266.

BACKGROUND OF THE INVENTION

1. Field of the Invention

The present invention relates to an electron emission device, and more particularly, the present invention relates to an electron emission device which has driving electrodes arranged perpendicularly to each other while interposing an insulating layer.

2. Description of Related Art

Generally, electron emission devices are classified into those using hot cathodes as an electron emission source, and those using cold cathodes as the electron emission source. There are several types of cold cathode electron emission devices, including a Field Emitter Array (FEA) device, a Metal-Insulator-Metal (MIM) device, a Metal-Insulator-Semiconductor (MIS) device, and a Surface Conduction Emitter (SCE) device.

The FEA electron emission device is based on the principle that when a material having a low work function or a high aspect ratio is used as an electron emission source, electrons are easily emitted from the electron emission source when an electric field is applied thereto under the vacuum atmosphere. A sharp-pointed tip structure based on molybdenum (Mo) or silicon (Si), or a carbonaceous material such as graphite has been used in forming electron emission regions.

In an FEA electron emission device, electron emission regions are formed on a first substrate together with cathode and gate electrodes functioning as the driving electrodes for controlling the electron emission. Phosphor layers are formed on a second substrate together with an anode electrode for accelerating the electrons emitted from the electron emission regions toward the phosphor layers. An insulating layer is disposed between the cathode and the gate electrodes to insulate them from each other, and the cathode and the gate electrodes are stripe-patterned and are perpendicular to each other.

With the above structure, the insulating layer can be formed with a small thickness of 10 micrometers to make micro-pixels. However, with the FEA electron emission device having an insulating layer of such a thickness, the surface of the insulating layer is rough depending upon the outline of the cathode electrodes. When a metallic material is deposited on the surface of the insulating layer to form gate electrodes, the gate electrodes also have a rough surface depending upon the surface state of the insulating layer.

Like the above, when the gate electrodes do not have a flat surface but rather have a rough surface, cracks are easily formed on the lateral edge of the gate electrode at the crossed region thereof with the cathode electrode. The cracks are propagated to the center of the gate electrode to locally increase the resistance of the gate electrode, and can even cause the breaking of the gate electrode. Such a problem becomes more serious as the thickness of the insulating layer is reduced.

SUMMARY OF THE INVENTION

In one exemplary embodiment of the present invention, an electron emission device is provided with a structure where two driving electrodes are arranged perpendicular to each other while interposing an insulating layer to prevent the occurrence of cracks on the driving electrodes arranged on the insulating layer.

In an exemplary embodiment of the present invention, the electron emission device includes first electrodes arranged on a substrate in a direction of the substrate, and an insulating layer formed on the entire surface of the substrate and covering the first electrodes. Second electrodes are arranged on the insulating layer perpendicular to the first electrodes. Electron emission regions are connected to one of the first and the second electrodes. The lateral edges of the first electrodes and the lateral edges of the second electrodes respectively cross each other, and the lateral edges of the first electrodes are inclined with respect to the lateral edges of the second electrodes on at least one crossed region thereof.

In the first case, the first electrodes have a predetermined width and the second electrodes have a variable-width portion at the region where the lateral edges thereof respectively cross the lateral edges of the first electrodes.

The respective second electrodes have a first region overlapped with the first electrodes and having a first width, a second region arranged between the first electrodes and having a second width different from the first width, and a third region arranged between the first and the second regions and having the variable-width portion.

When the first width is larger than the second width, the variable-width portions of the second electrodes and the lateral edges of the first electrodes respectively cross each other at an inclination angle of 105~165°. By contrast, when the first width is smaller than the second width, the variable-width portions of the second electrodes and the lateral edges of the first electrodes respectively cross each other at an inclination angle of 15~75°.

In the second case, the second electrodes have a predetermined width and the first electrodes have a variable-width portion at the region where the lateral edges thereof cross the lateral edges of the second electrodes.

The respective first electrodes have a first region overlapped with the second electrodes and having a third width, a second region arranged between the second electrodes and having a fourth width different from the third width, and a third region arranged between the first and the second regions and having the variable-width portion.

When the third width is larger than the fourth width, the variable-width portion of the first electrodes and the lateral edges of the second electrodes respectively cross each other at an inclination angle of 105~165°. By contrast, when the third width is smaller than the fourth width, the variable-width portions of the first electrodes and the lateral edges of the second electrodes respectively cross each other at an inclination angle of 15~75°.

The insulating layer has a thickness at least twice the thickness of the first electrodes. The insulating layer has a thickness of less than 10 micrometers.

The electron emission regions are arranged on the first electrodes, and the second electrodes and the insulating layer have opening portions exposing the electron emission regions, respectively. The insulating layer has a top surface arranged on a plane higher than a top surface of the electron emission regions. The electron emission regions can be placed at the one-sided peripheries of the second electrodes and contacting the second electrodes.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
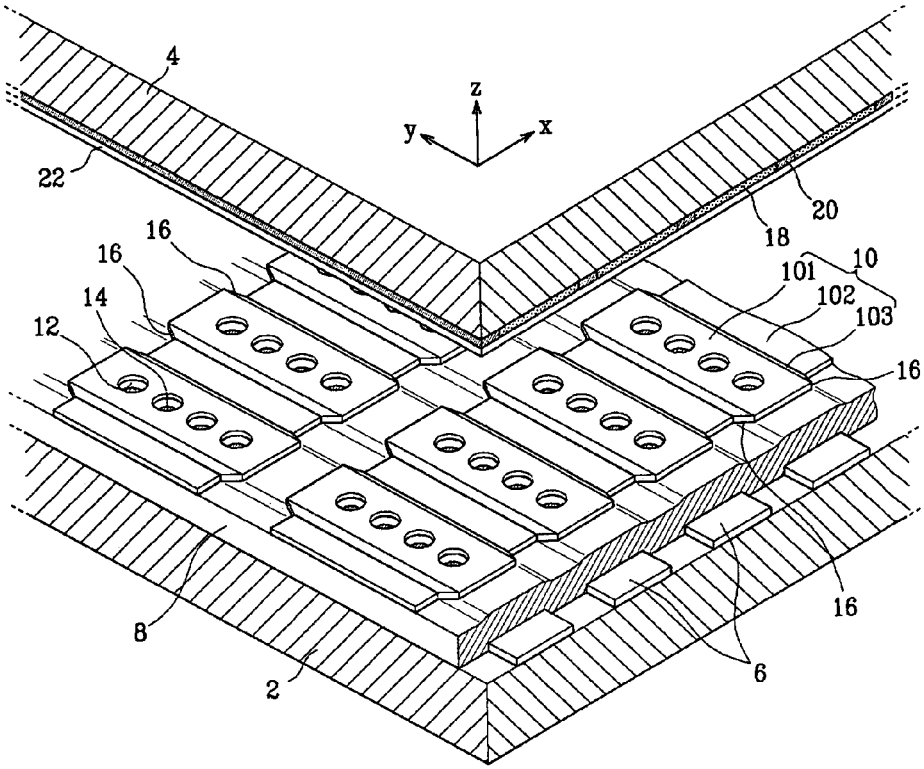
FIG. 1 is a partial exploded perspective view of an electron emission device according to a first embodiment of the present invention.
Figure 2:
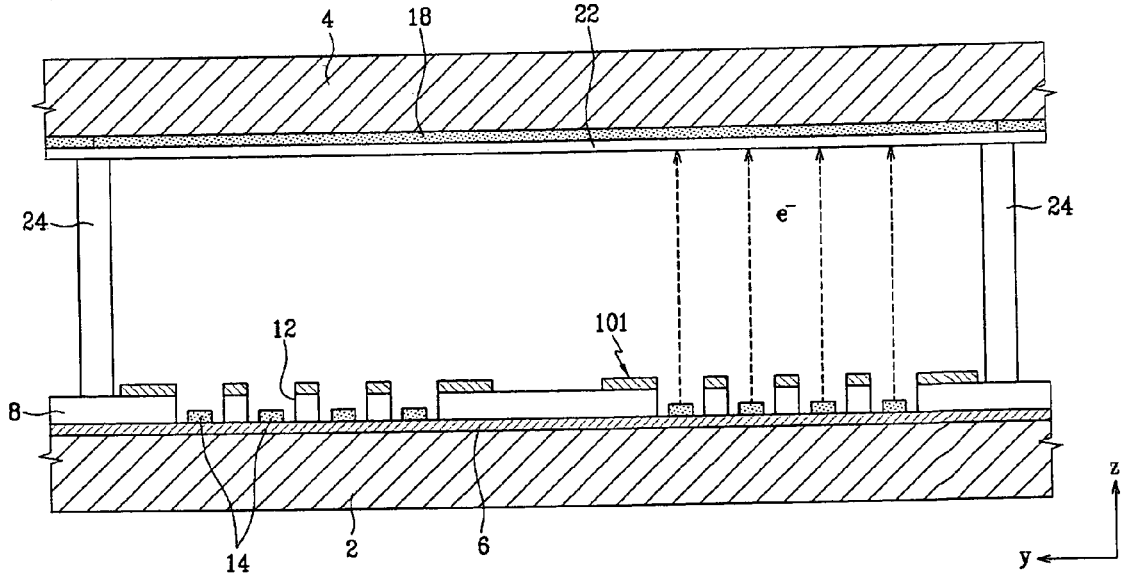
FIG. 2 is a partial sectional view of the electron emission device according to the first embodiment of the present invention.
Figure 3:
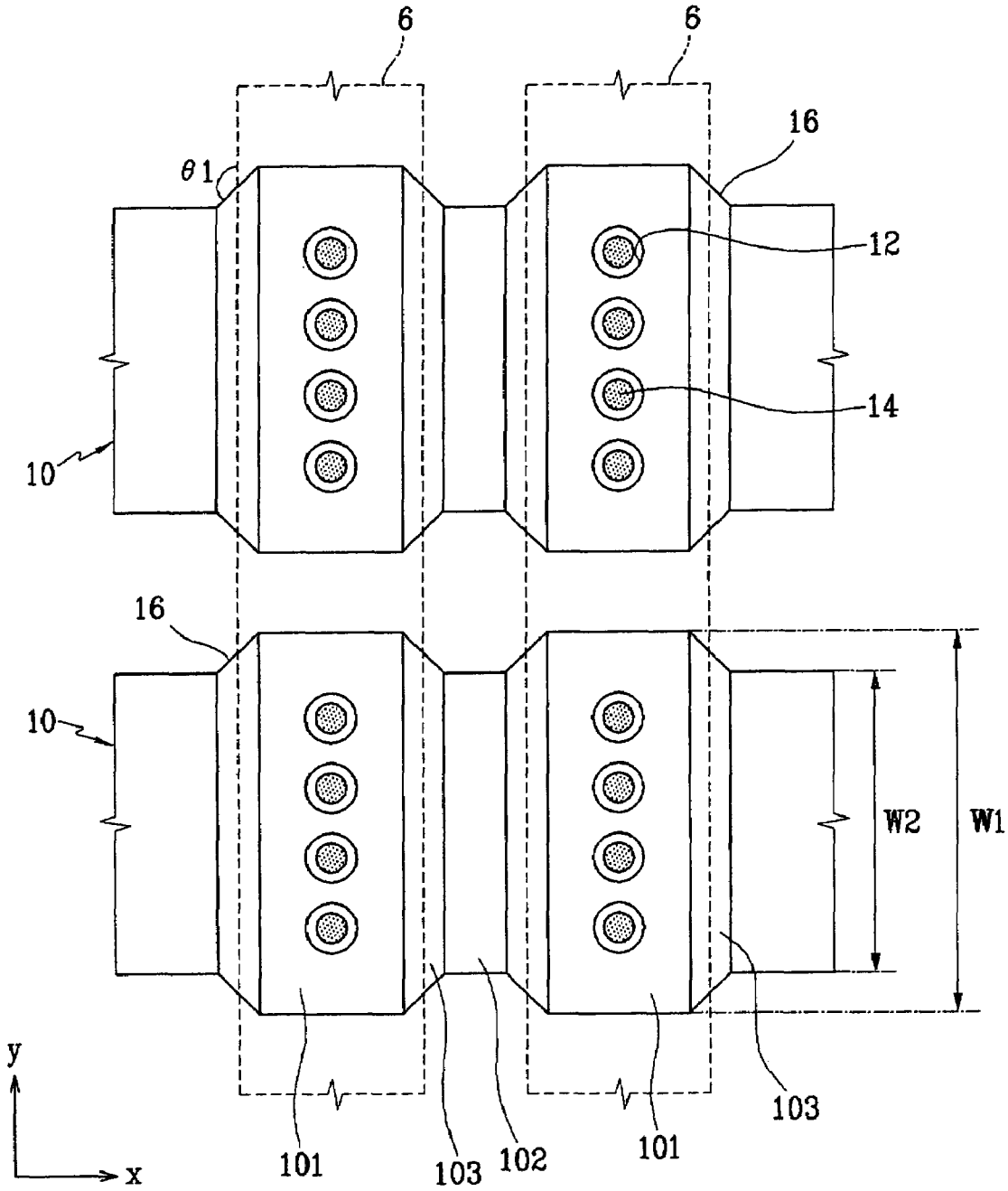
FIG. 3 is a partial plan view of a structure on a first substrate for the electron emission device according to the first embodiment of the present invention.

As shown in FIGS. 1 to 3, the electron emission device according to a first embodiment of the present invention has first and second substrates 2 and 4 facing each other and spaced apart from each other. An electron emission structure is formed on the first substrate 2, and a light emission structure is formed on the second substrate 4 to emit visible light rays due to the electrons.

First electrodes 6 (referred to hereinafter as the "cathode electrodes") are stripe-patterned on the first substrate 2 and an insulating layer 8 is formed on the entire surface of the first substrate 2 to cover the cathode electrodes 6. Second electrodes 10 (referred to hereinafter as the "gate electrodes") are stripe-patterned and arranged on the insulating layer 8 and are perpendicular to the cathode electrodes 6.

The insulating layer 8 can be formed by Chemical Vapor Deposition (CVD)-depositing $SiO_2$. The thickness of the insulating layer 8 is preferably two or more times greater than that of the cathode electrode 6, but not exceeding 10 micrometers. When the thickness of the insulating layer 8 is less than two times that of the cathode electrode 6, it is difficult to sufficiently insulate the cathode and the gate electrodes 6 and 10 from each other. When the thickness of the insulating layer 8 exceeds 10 micrometers, it is difficult to fabricate micro-pixels. However, the forming the insulating layer 8 and the thickness of the insulating layer 8 are not limited to the above.

The insulating layer 8 has a rough surface depending upon the outline of the cathode electrode 6, and the gate electrode 10 also has a rough surface depending upon the surface roughness of the insulating layer 8.

With the above structure, when the crossed regions of the cathode and the gate electrodes 6 and 10 are defined as pixel regions, at least one opening portion 12 is formed at the insulating layer 8 and the gate electrode 10 at each pixel region to partially expose the surface of the cathode electrode 6. Electron emission regions 14 are formed on the cathode electrode 6 within the opening portion 12. The top surface of the insulating layer 8 is placed on a plane higher than the top surface of the electron emission regions 14 such that the gate electrodes 10 are placed on a plane higher than the electron emission regions 14.

In FIGS. 1-3, four electron emission regions 14 are provided at each pixel region, the regions arranged in the direction of the length of the cathode electrode 6, and the plane shape of the electron emission regions 14 and the opening portions 12 form a circle. However, the arrangement of the electron emission regions 14 is not limited thereto.

In this embodiment, the electron emission regions 14 are formed with a material emitting electrons under the application of an electric field, such as a carbonaceous material and a nanometer-sized material. The electron emission regions 14 are preferably formed of carbon nano-tubes, graphite, graphite nano-fibers, diamonds, diamond-like carbon, $C_{60}$, silicon nano-wires, or a combination thereof. The electron emission regions 14 can be formed through direct growth, screen printing, Chemical Vapor Deposition (CVD), or sputtering.

In this embodiment, the cathode electrode 6 has a predetermined width, whereas the gate electrode 10 has a variable-width portion 16 at the crossed region of the lateral edge thereof with the lateral edge of the cathode electrode 6.

Specifically, the gate electrode 10 has a first region 101, overlapped with the cathode electrode, and having a width of w1, a second region 102 disposed between the cathode electrodes 6 and having a width of w2 which is smaller than the width w1, and a third region 103 disposed between the first and the second regions 101 and 102 and having a variable-width portion 16. Accordingly, the variable-width portion 16 of the gate electrode 10 and the lateral edge of the cathode electrode 6 cross each other with an obtuse inclination angle (θ1), as shown in FIG. 3.

The third region 103 is overlapped with the lateral edge of the cathode electrode 6. With the third region 103, the gate electrode 10 makes formation of a predetermined inclined side between the first and the second regions 101 and 102 as it is not flat in the longitudinal direction thereof due to the thickness of the cathode electrode 6.

With the third region 103, the variable-width portion 16 enlarges the length of the lateral edge of the gate electrode 10 to slowly induce the local inclination variation of the gate electrode 10. Accordingly, with the electron emission device according to this embodiment of the present invention, the stress concentration of the gate electrode 10 due to the variable-width portion 16 is reduced to thereby prevent the occurrence of cracks at the gate electrode 10.

The variable-width portion 16 of the gate electrode 10 can be inclined with respect to the lateral edge of the cathode electrode 6 at an inclination angle of 105°~165° (θ1). This angle is the value of plus or minus 30° from 135°. If the inclination angle does not satisfy the above range, the electric field applied to each pixel region during driving the electron emission device can be non-uniform, thereby deteriorating luminescent uniformity when an alignment error occurs between the cathode electrode 6 and the gate electrode 10.

Phosphor layers 18 and black layers 20 are formed on a surface of the second substrate 4 facing the first substrate 2, and an anode electrode 22 is formed on the phosphor layers 18 and the black layers 20 with a metallic material, such as aluminum Al. The anode electrode 22 receives a high voltage required for accelerating the electron beams, and reflects the visible light rays radiated from the phosphor layers 18 to the first substrate 2 toward the second substrate 4, thereby heightening the screen luminance.

The anode electrode 22 is formed of a transparent conductive material, such as Indium Tin Oxide (ITO). The anode electrode is arranged on the surface of the phosphor layers and black layers facing the second substrate, and is patterned with a plurality of separate portions.

A sealant, such as a seal frit, is applied to the peripheries of the first and the second substrates 2 and 4, which are then sealed to each other. Spacers 24 are arranged between the first and the second substrates 2 and 4 to space them apart from each other while supporting them.

With the above-structured electron emission device, when predetermined driving voltages are supplied to the cathode and the gate electrodes 6 and 10, an electric field is formed around the electron emission regions 14 at the pixels where the voltage difference between the two electrodes exceeds the threshold value, and electrons are emitted from the electron emission regions 14. The emitted electrons are attracted by the high voltage supplied to the anode electrode 22, and directed toward the second substrate 4, thereby colliding against the phosphor layers 18 at the relevant pixels and causing them to emit light.

With the electron emission device according to this embodiment of the present invention, since the gate electrode 10 has a variable-width portion 16, the occurrence of cracks in the gate electrode 10 is inhibited, thereby preventing the gate electrode from having an increased resistance, and preventing the gate electrode from being damaged.

Figure 4:
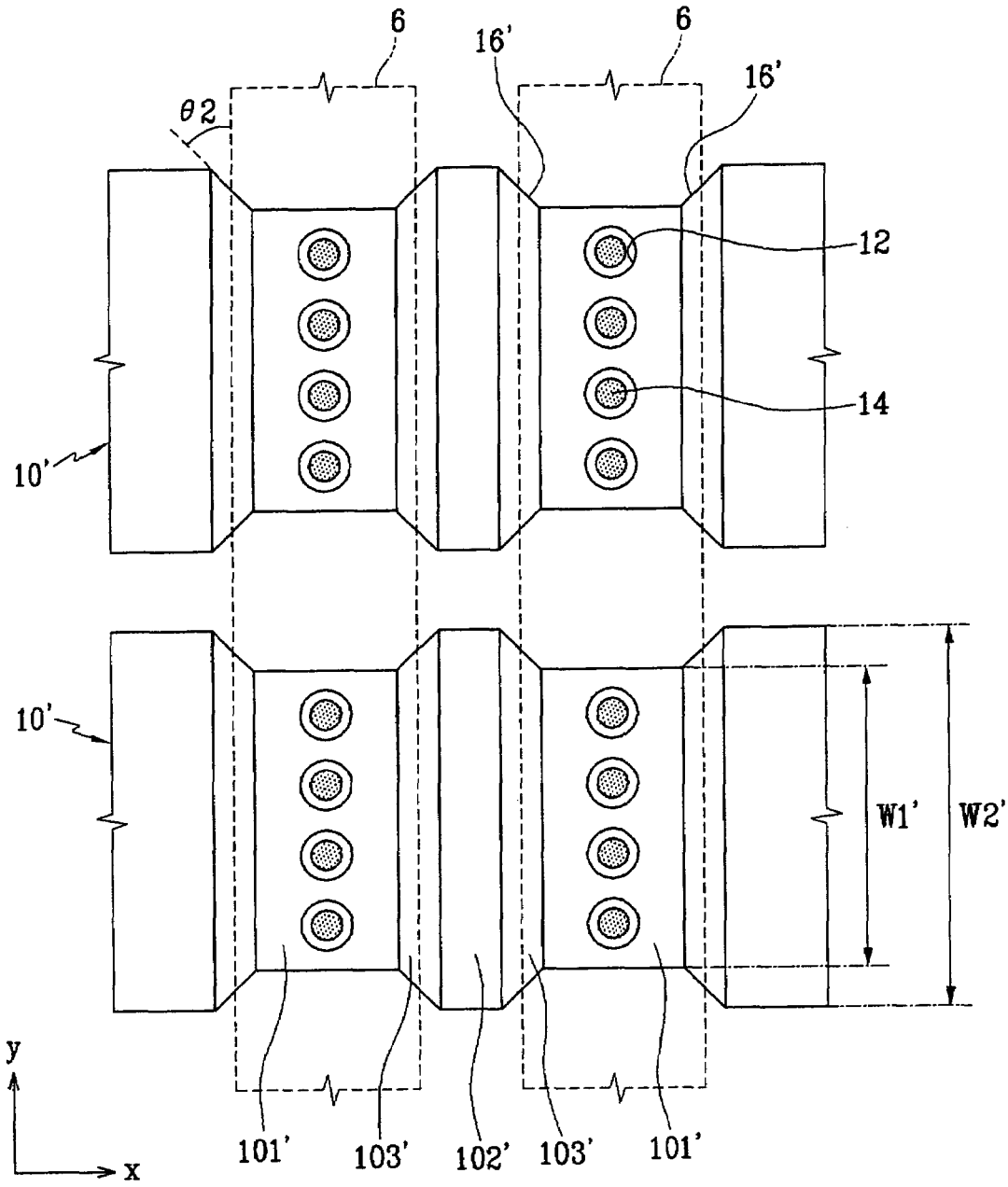
FIG. 4 is a partial plan view of a structure on a first substrate for an electron emission device according to a second embodiment of the present invention.

As shown in FIG. 4, with an electron emission device according to a second embodiment of the present invention, a variable-width portion 16' of a gate electrode 10' and the lateral edge of a cathode electrode 6 cross each other at an acute inclination angle (θ2).

That is, in this embodiment, the respective gate electrodes 10' have a first region 101' overlapped with the cathode electrode 6 and having a width of w1', a second region 102' disposed between the cathode electrodes 6 and having a width of w2' greater than that of w1', and a third region 103' disposed between the first and the second regions 101' and 102' and having a variable-width portion 16'.

The variable-width portion 16' of the gate electrode 10' can be inclined with respect to the lateral edge of the cathode electrode 6 at an angle of 15°~75° (θ2). This angle is the value of plus or minus 30° from 45°. If the inclination angle does not satisfy the above range, the electric field applied to each pixel region during driving the electron emission device can be non-uniform, thereby deteriorating the luminescent uniformity when an alignment error occurs between the cathode electrode 6 and the gate electrode 10'.

Alternatively, the variable-width portion can be provided at the cathode electrode, rather than at the gate electrode.

Figure 5:
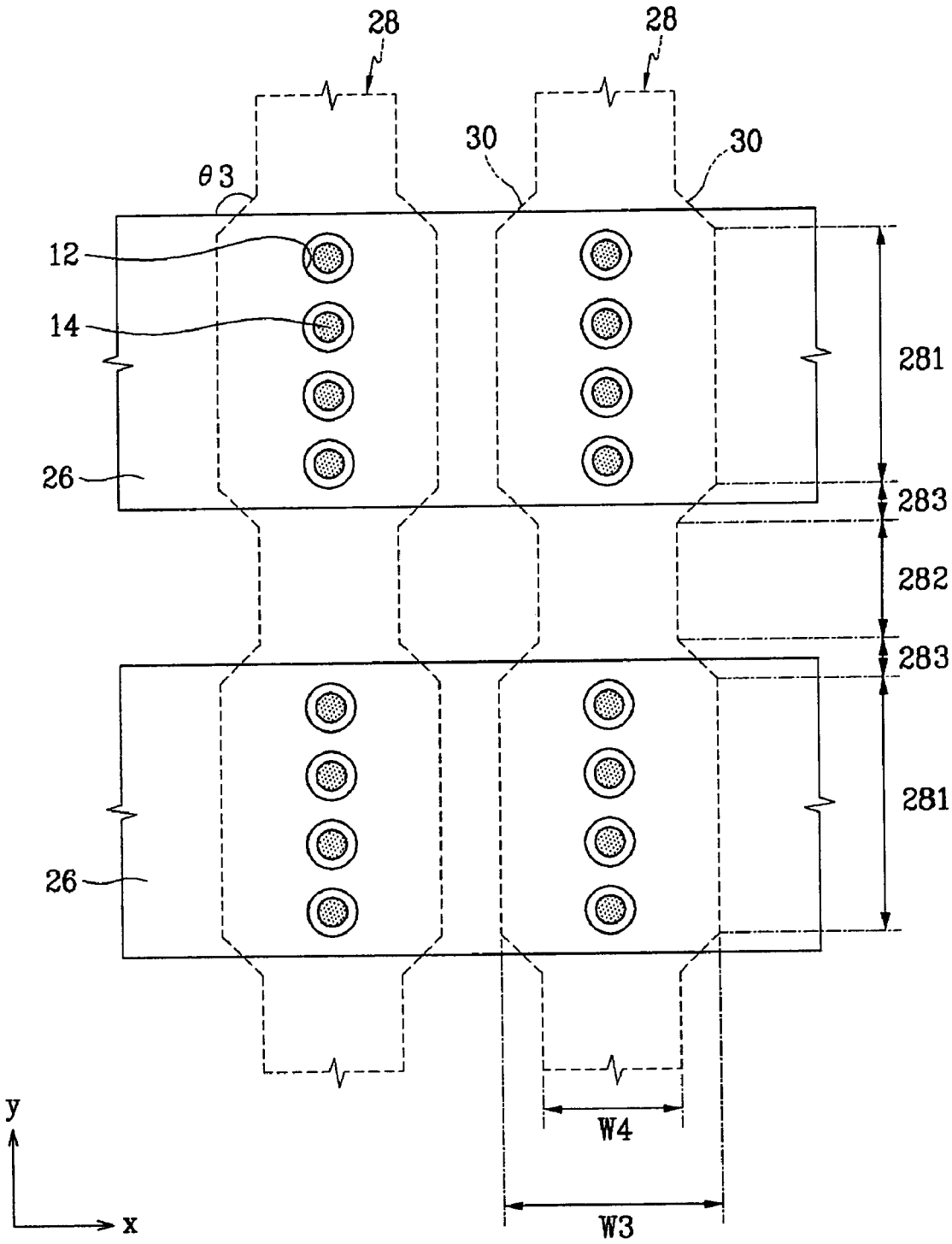
FIG. 5 is a partial plan view of a structure on a first substrate for an electron emission device according to a third embodiment of the present invention.

As shown in FIG. 5, with an electron emission device according to a third embodiment of the present invention, a gate electrode 26 has a predetermined width, and a cathode electrode 18 has a variable-width portion 30 at the region where the lateral edge thereof crosses the lateral edge of the gate electrode 26.

In this embodiment, the respective cathode electrodes 28 have a first region 281 overlapped with the gate electrode 26 and having a width of w3, a second region 282 disposed between the gate electrodes 26 and having a width of w4 smaller than the that of w3, and a third region 283 disposed between the first and the second regions 281 and 282 and having a variable-width portion 30.

Accordingly, the variable-width portion 30 of the cathode electrode 28 and the lateral edge of the gate electrode 26 cross each other at an obtuse inclination angle (θ3). The variable-width portion 30 of the cathode electrode 28 slowly induces the local inclination variation of the gate electrode 26, and reduces the stress concentration of the gate electrode 26 due to the inclination variation thereof. The inclination angle (θ3) is in the range of 105°~165°.

Figure 6:
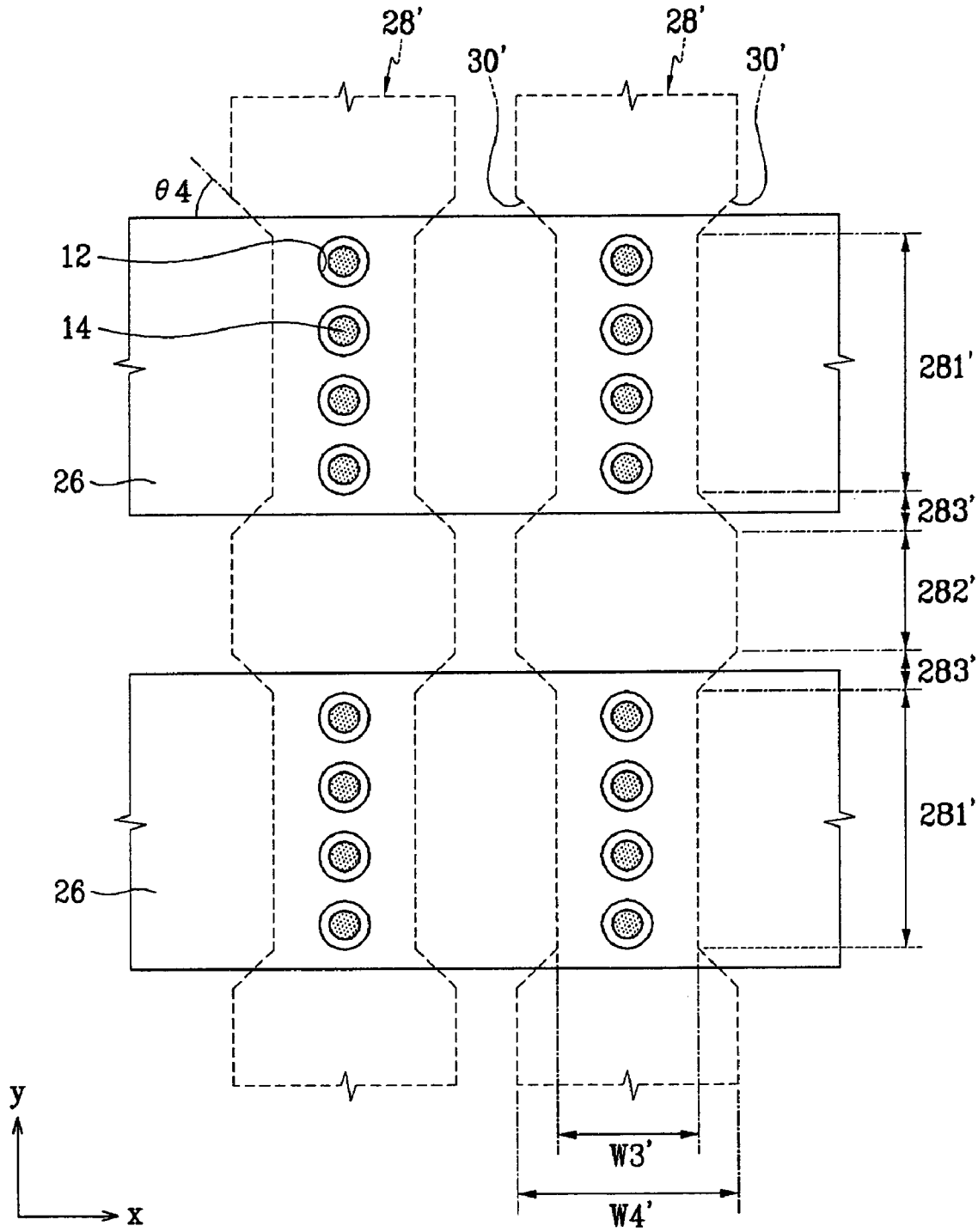
FIG. 6 is a partial plan view of a structure on a first substrate for an electron emission device according to a fourth embodiment of the present invention.

As shown in FIG. 6, with an electron emission device according to a fourth embodiment of the present invention, a variable-width portion 30' of a cathode electrode 28' and the lateral edge of a gate electrode 26 cross each other at an acute inclination angle (θ4).

That is, in this embodiment, the respective cathode electrodes 28' have a first region 281' overlapped with the gate electrodes 26 and having a width of w3', a second region 282' disposed between the gate electrodes 26 and having a width of w4' greater than that of of w3', and a third region 283' disposed between the first and the second regions 281' and 282' and having a variable-width portion 30'. The inclination angle (θ4) is in the range of 15°~75°.

Figure 7:
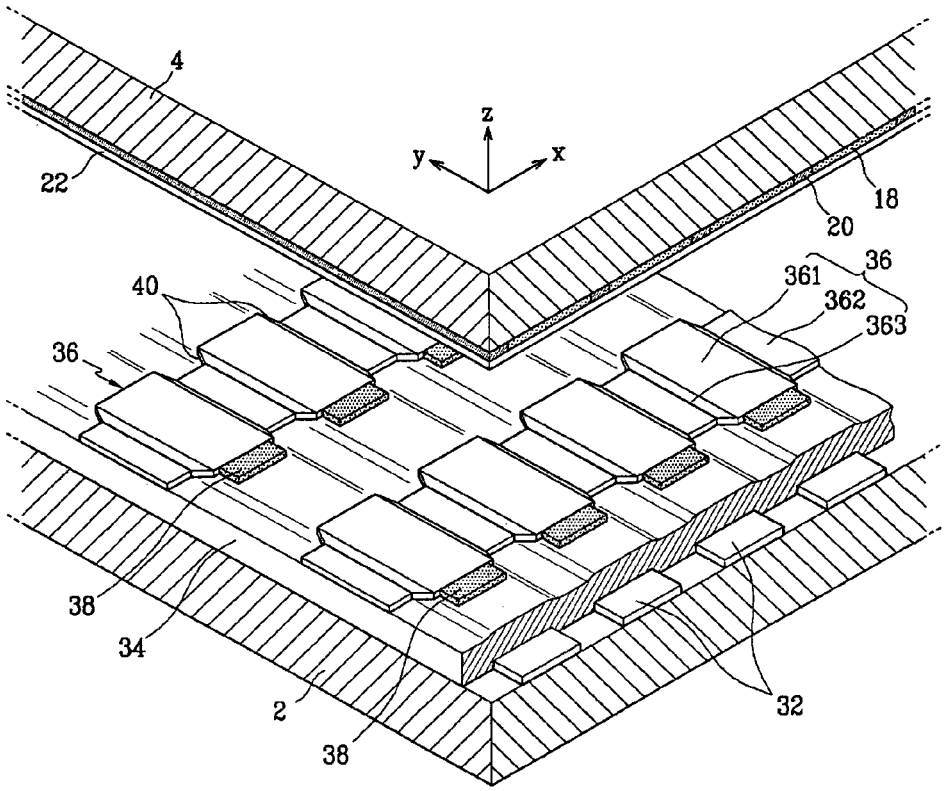
FIG. 7 is a partial exploded perspective view of an electron emission device according to a fifth embodiment of the present invention.
Figure 8:
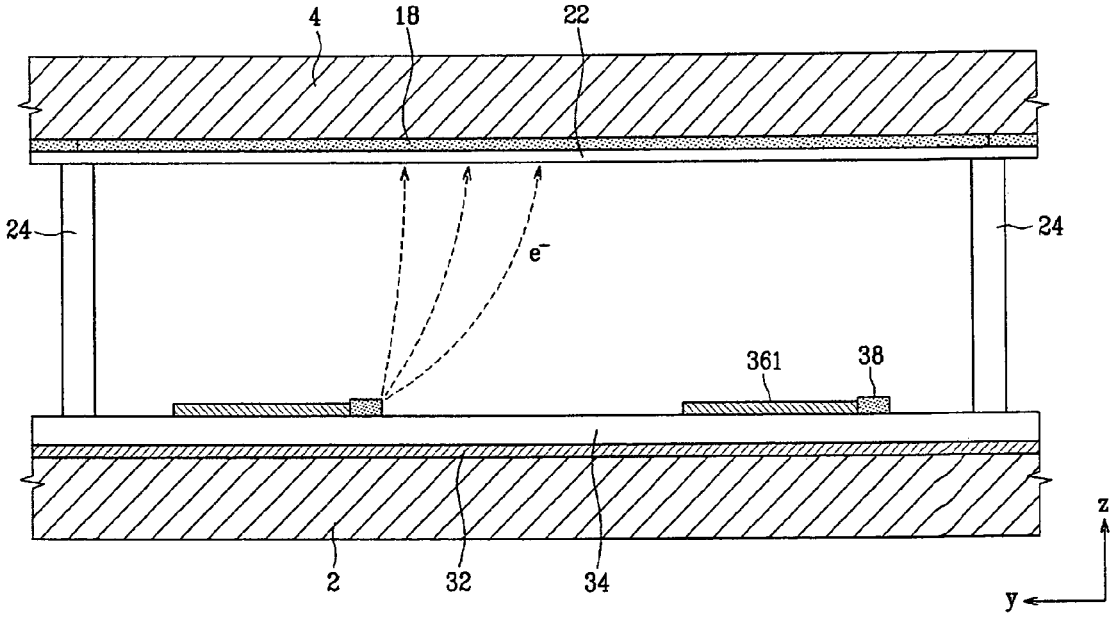
FIG. 8 is a partial sectional view of the electron emission device according to the fifth embodiment of the present invention.
Figure 9:
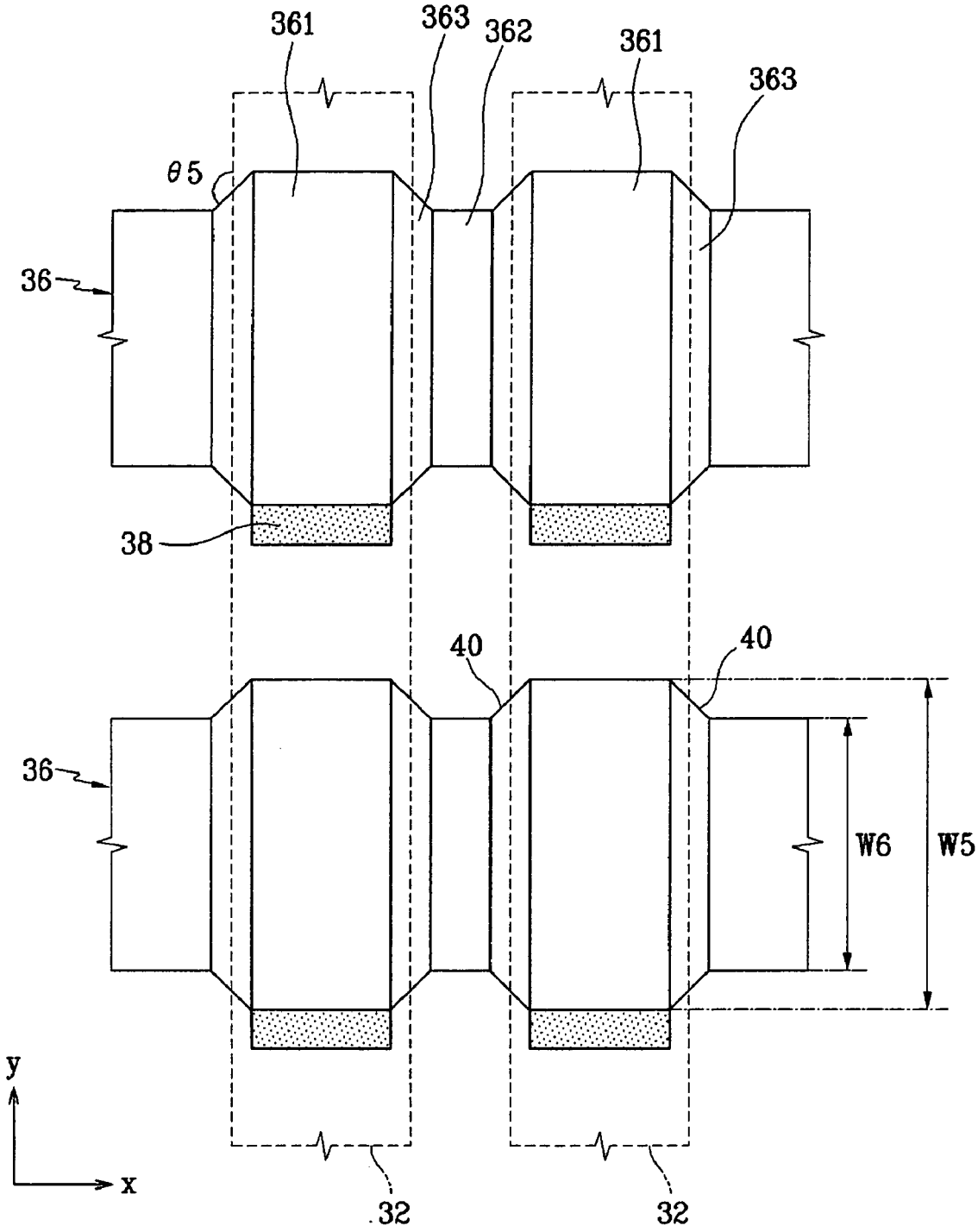
FIG. 9 is a partial plan view of a structure on a first substrate for the electron emission device according to the fifth embodiment of the present invention.

As shown in FIGS. 7 to 9, with an electron emission device according to a fifth embodiment of the present invention, first electrodes 32 (referred to hereinafter as the "gate electrodes"), an insulating layer 34 and second electrodes 36 (referred to hereinafter as the "cathode electrodes") are sequentially formed on a first substrate 2. The gate and the cathode electrodes 32 and 36 are stripe-patterned and are perpendicular to each other. Electron emission regions 38 are placed at one-sided peripheries of the cathode electrodes 36 while contacting the cathode electrodes 36 at the respective regions where the gate and the cathode electrodes 32 and 36 cross.

With the above-structured electron emission device, when predetermined driving voltages are supplied to the gate and the cathode electrodes 32 and 36, an electric field is formed around the electron emission regions 38 at the pixels where the voltage difference between the two electrodes exceeds the threshold value, and electrons are emitted from the electron emission regions 38. The emitted electrons are attracted by the high voltage supplied to the anode electrode 22, and directed toward the second substrate 4, thereby colliding against the phosphor layers 18 at the relevant pixels and emitting light. In this embodiment, the gate electrode 32 has a predetermined width, whereas the cathode electrode 36 has a variable-width portion 40 at the region where the lateral edge thereof crosses the lateral edge of the gate electrode 32.

That is, the respective cathode electrodes 36 have a first region 361 overlapped with the gate electrode 32 and having a width of w5, a second region 362 disposed between the gate electrodes 32 and having a width of w6 smaller than the value of w5, and a third region 363 disposed between the first and the second regions 361 and 362 and having a variable-width portion 40.

Accordingly, the variable-width portion 40 of the cathode electrode 36 and the lateral edge of the gate electrode 32 cross each other at an obtuse inclination angle (θ5), as shown in FIG. 9. The variable-width portion 40 of the cathode electrode 36 slowly induces the local inclination variation of the cathode electrode 36, and decreases the stress concentration of the cathode electrode 36 due to the inclination variation thereof. The inclination angle (θ5) is in the range of 105°~165°.

Figure 10:
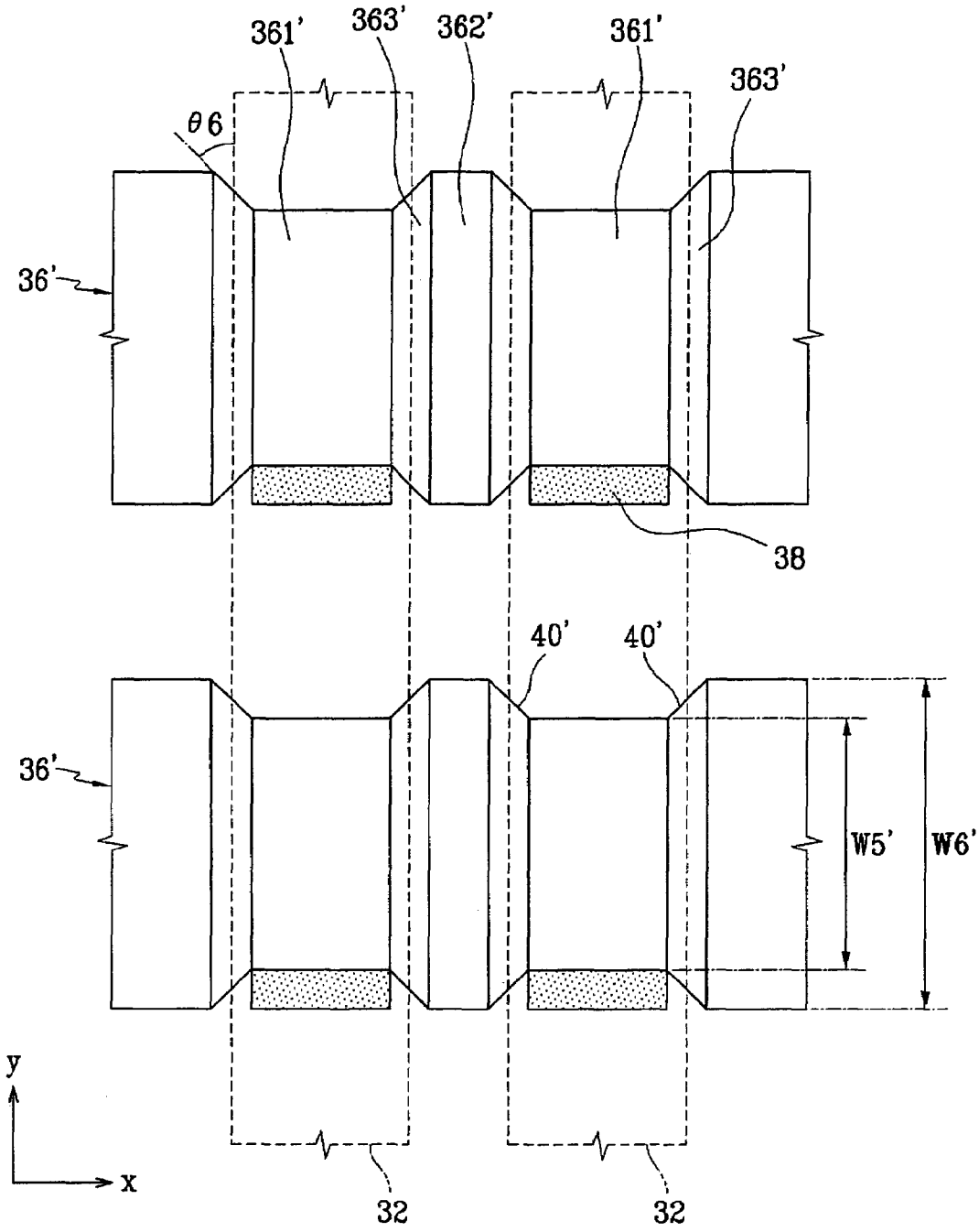
FIG. 10 is a partial plan view of a structure on a first substrate for an electron emission device according to a sixth embodiment of the present invention.

As shown in FIG. 10, with an electron emission device according to a sixth embodiment of the present invention, a variable-width portion 40' of a cathode electrode 36' and the lateral edge of a gate electrode 32 cross each other at an acute inclination angle (θ6).

That is, in this embodiment, the respective cathode electrodes 36'have a first region 361' overlapped with the gate electrode 32 and having a width of w5', a second region 362' disposed between the gate electrodes 32 and having a width of w6' greater than that of w5', and a third region 363' disposed between the first and the second regions 361' and 362' and having a variable-width portion 40'. The inclination angle (θ6) is in the range of 15°~75°.

Figure 11:
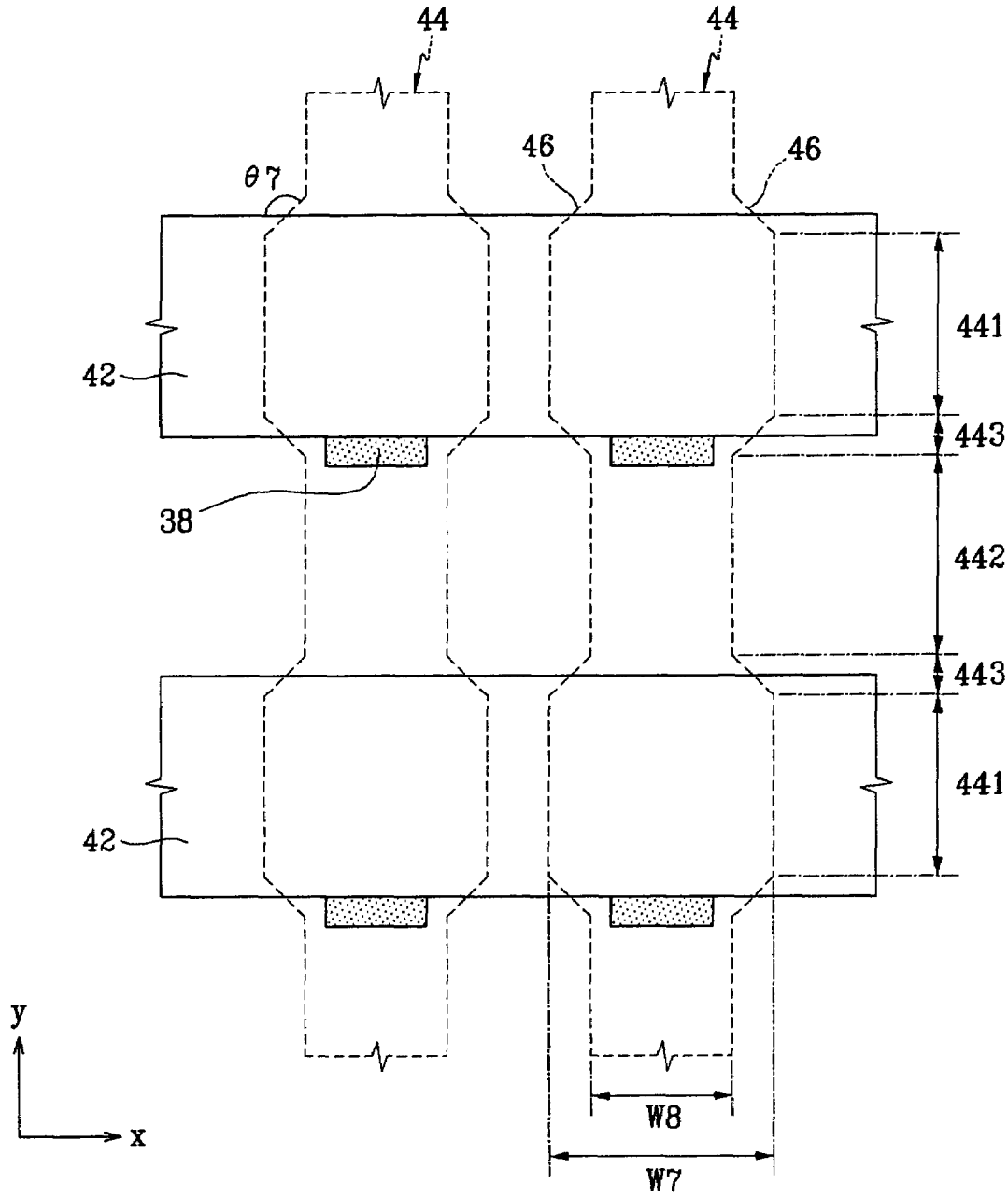
FIG. 11 is a partial plan view of a structure on a first substrate for an electron emission device according to a seventh embodiment of the present invention.

As shown in FIG. 11, with an electron emission device according to a seventh embodiment of the present invention, a cathode electrode 42 has a predetermined width, whereas a gate electrode 44 has a variable-width portion 46 at the region where the lateral edge thereof crosses the lateral edge of the cathode electrode 42.

In this embodiment, the respective gate electrodes 44 have a first region 441 overlapped with the cathode electrode 42 and having a width of w7, a second region 442 disposed between the cathode electrodes 42 and having a width of w8 smaller than that of w7, and a third region 443 disposed between the first and the second regions 441 and 442 and having a variable-width portion 46.

Accordingly, the variable-width portion 46 of the gate electrode 44 and the lateral edge of the cathode electrode 42 cross each other at an obtuse inclination angle (θ7). The variable-width portion 46 of the gate electrode 44 slowly induces the local inclination variation of the cathode electrode 42, and decreases the stress concentration of the cathode electrode 42 due to the inclination variation thereof. The inclination angle (θ7) is in the range of 105°~165°.

Figure 12:
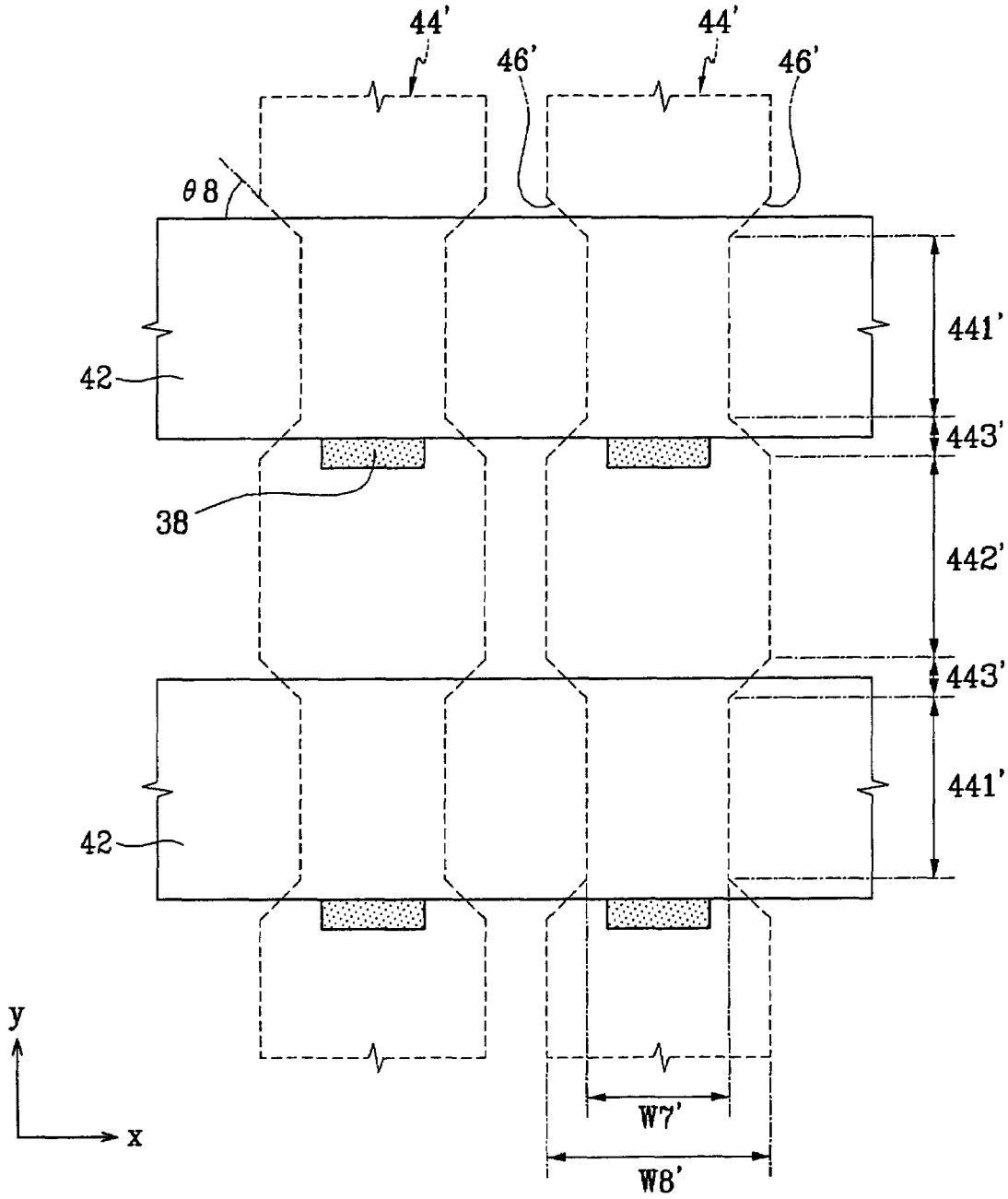
FIG. 12 is a partial plan view of a structure on a first substrate for an electron emission device according to an eighth embodiment of the present invention.

As shown in FIG. 12, with an electron emission device according to an eighth embodiment of the present invention, a variable-width portion 46' of a gate electrode 44' and the lateral edge of a cathode electrode 42 cross each other at an acute inclination angle (θ8).

That is, in this embodiment, the respective gate electrodes 44' have a first region 441' overlapped with the cathode electrode 42 and having a width of w7', a second region 442' disposed between the cathode electrodes 42 and having a width of w8' greater than that of w7', and a third region 443' disposed between the first and the second regions 441' and 442' and having a variable-width portion 46'. The inclination angle (θ8) is in the range of 15°~75°.

As described above, with an electron emission device according to the present invention, a variable-width portion is formed on one of the first and the second electrodes to prevent the occurrence of cracks in the second electrodes formed on the insulating layer. The electrode with the variable-width portion preferably involves a relatively small amount of current flow, low resistance, and lowered voltage drop.

While the present invention has been described in connection with certain exemplary embodiments, it is to be understood by those skilled in the art that the present invention is not limited to the disclosed embodiments, but, on the contrary, is intended to cover various modifications included within the spirit and scope of the appended claims.

What is claimed is:

1. An electron emission device, comprising:

first electrodes arranged on a substrate in a direction of the substrate;

an insulating layer arranged on an entire surface of the substrate and covering the first electrodes;

second electrodes arranged on the insulating layer and perpendicular to the first electrodes; and electron emission regions respectively connected to one of the first and the second electrodes;

wherein lateral edges of the first electrodes and lateral edges of the second electrodes respectively cross each other;

wherein the lateral edges of the first electrodes are respectively inclined with respect to the lateral edges of the second electrodes in at least one region thereof where the lateral edges of the first electrodes cross the lateral edges of the second electrodes; and wherein each first electrode has a predetermined width, and each second electrode has a variable-width portion at said at least one region thereof where the lateral edges of the first electrodes cross the lateral edges of the second electrodes.

2. The electron emission device of claim 1, wherein the insulating layer has a thickness at least twice the thickness of the first electrodes.

3. The electron emission device of claim 1, wherein the respective second electrodes have a first region overlapped with the first electrodes and having a first width, a second region arranged between the first electrodes and having a second width different from the first width, and a third region arranged between the first and the second regions and having the variable-width portion.

4. The electron emission device of claim 3, wherein the first width is larger than the second width, and wherein the variable-width portion of the second electrodes and the lateral edges of the first electrodes respectively cross each other at an inclination angle in a range of 105°~165°.

5. The electron emission device of claim 3, wherein the first width is smaller than the second width, and wherein the variable-width portion of the second electrodes and the lateral edges of the first electrodes respectively cross each other at an inclination angle in a range of 15°~75°.

6. The electron emission device of claim 1, wherein the insulating layer has a thickness of less than 10 micrometers.

7. The electron emission device of claim 1, wherein the electron emission regions are of a material selected from a group consisting of carbon nano-tubes, graphite, graphite nano-fibers, diamonds, diamond-like carbon, $C_{60}$ and silicon nano-wires.

8. An electron emission device comprising:

first electrodes arranged on a substrate in a direction of the substrate;

an insulating layer arranged on an entire surface of the substrate and covering the first electrodes;

second electrodes arranged on the insulating layer and perpendicular to the first electrodes; and electron emission regions respectively connected to one of the first and the second electrodes;

wherein lateral edges of the first electrodes and lateral edges of the second electrodes respectively cross each other;

wherein the lateral edges of the first electrodes are respectively inclined with respect to the lateral edges of the second electrodes in at least one region thereof where the lateral edges of the first electrodes cross the lateral edges of the second electrodes;

wherein the second electrodes have a predetermined width, and wherein the first electrodes have a variable-width portion at the region thereof where the lateral edges of the first electrodes cross the lateral edges of the second electrodes; and wherein the respective first electrodes have a first region overlapped with the second electrodes and having a first width, a second region arranged between the second electrodes and having a second width different from the first width, and a third region arranged between the first and the second regions and having the variable-width portion.

9. The electron emission device of claim 8, wherein the first width is greater than the second width, and wherein the variable-width portions of the first electrodes and the lateral edges of the second electrodes respectively cross each other at an inclination angle in a range of 105°~165°.

10. The electron emission device of claim 8, wherein the first width is smaller than the second width, and wherein the variable-width portions of the first electrodes and the lateral edges of the second electrodes respectively cross each other at an inclination angle in a range of 15°~75°.

11. An electron emission device, comprising:

first electrodes arranged on a substrate in a direction of the substrate;

an insulating layer arranged on an entire surface of the substrate and covering the first electrodes;

second electrodes arranged on the insulating layer and perpendicular to the first electrodes; and electron emission regions respectively connected to one of the first and the second electrodes;

wherein lateral edges of the first electrodes and lateral edges of the second electrodes respectively cross each other; and wherein the lateral edges of the first electrodes are respectively inclined with respect to the lateral edges of the second electrodes in at least one region thereof where the lateral edges of the first electrodes cross the lateral edges of the second electrodes;

said device further comprising a counter substrate facing the substrate, phosphor layers arranged on the counter substrate, and at least one anode electrode arranged on a surface of the phosphor layers.

12. An electron emission device comprising:

first electrodes arranged on a substrate in a direction of the substrate;

an insulating layer arranged on an entire surface of the substrate and covering the first electrodes;

second electrodes arranged on the insulating layer and perpendicular to the first electrodes; and electron emission regions respectively connected to one of the first and the second electrodes;

wherein lateral edges of the first electrodes and lateral edges of the second electrodes respectively cross each other;

wherein the lateral edges of the first electrodes are respectively inclined with respect to the lateral edges of the second electrodes in at least one region thereof where the lateral edges of the first electrodes cross the lateral edges of the second electrodes; and wherein the electron emission regions are arranged on the first electrodes, and the second electrodes and the insulating layer respectively have opening portions exposing the electron emission regions.

13. The electron emission device of claim 12, wherein the insulating layer has a top surface arranged on a plane higher than a top surface of the electron emission regions.

14. An electron emission device comprising:

first electrodes arranged on a substrate in a direction of the substrate;

an insulating layer arranged on an entire surface of the substrate and covering the first electrodes;

second electrodes arranged on the insulating layer and perpendicular to the first electrodes; and electron emission regions respectively connected to one of the first and the second electrodes;

wherein lateral edges of the first electrodes and lateral edges of the second electrodes respectively cross each other;

wherein the lateral edges of the first electrodes are respectively inclined with respect to the lateral edges of the second electrodes in at least one region thereof where the lateral edges of the first electrodes cross the lateral edges of the second electrodes; and wherein the electron emission regions are arranged at one-sided peripheries of the second electrodes and contact the second electrodes.

* * * * *